US010174450B2

(12) United States Patent
Akkad

(10) Patent No.: US 10,174,450 B2
(45) Date of Patent: Jan. 8, 2019

(54) REVERSIBLE SEQUIN PATTERN SHEET

(71) Applicant: Idea Nuova, Inc., New York, NY (US)

(72) Inventor: Benjamin S. Akkad, New York, NY (US)

(73) Assignee: Idea Nuova, Inc., New York, NY (US)

( * ) Notice: Subject to any disclaimer, the term of this patent is extended or adjusted under 35 U.S.C. 154(b) by 103 days.

(21) Appl. No.: 15/211,385

(22) Filed: Jul. 15, 2016

(65) Prior Publication Data

US 2018/0016724 A1 Jan. 18, 2018

(51) Int. Cl.

| | |
|---|---|
| ***D05C 17/00*** | (2006.01) |
| ***D05C 7/00*** | (2006.01) |
| ***D04D 7/02*** | (2006.01) |
| ***D04D 7/04*** | (2006.01) |

(52) U.S. Cl.

CPC ..... *D05C 17/00* (2013.01); *D04D 7/02* (2013.01); *D04D 7/04* (2013.01); *D05C 7/00* (2013.01)

(58) Field of Classification Search

CPC ... D05C 17/00; D05C 7/00–7/08; D05B 3/12; D05B 3/22; B32B 3/08; D04D 7/02; D04D 7/04; B65C 5/00; G09F 19/14

See application file for complete search history.

(56) References Cited

U.S. PATENT DOCUMENTS

| | | | | |
|---|---|---|---|---|
| 700,305 A * | 5/1902 | Cornely | ..... | D04D 1/04 112/99 |
| 1,107,599 A * | 8/1914 | Fink | ..... | D04D 1/04 112/99 |
| 2012/0045605 A1* | 2/2012 | Collins | ..... | B32B 5/024 428/52 |

FOREIGN PATENT DOCUMENTS

| | | | |
|---|---|---|---|
| CN | 202220273 U | * | 5/2012 |
| CN | 103696185 A | * | 4/2014 |
| CN | 20531249 U | * | 6/2016 |
| WO | WO 2015027234 A2 | * | 2/2015 |

* cited by examiner

*Primary Examiner* — Ismael Izaguirre
(74) *Attorney, Agent, or Firm* — Panitch Schwarze Belisario & Nadel LLP

(57) ABSTRACT

A reversible sequin pattern sheet includes a layer of fabric positionable substantially in a plane and a plurality of sequins each having a first surface and a second surface opposite the first surface, the sequins being arranged in an array. Each sequin includes an aperture extending between the first and second surfaces, at least a portion of the first and second surfaces of the sequins having different indicia thereon. A thread extending through each aperture is secured to the fabric layer for securing the sequins to the fabric layer and for allowing each sequin to pivot with respect to the fabric layer between a first position and a second position. The indicia are selected such that when the array is in the first position a first message is conveyed, and when the array is in the second position a second message is conveyed.

3 Claims, 5 Drawing Sheets

REVERSIBLE SEQUIN PATTERN SHEET

BACKGROUND OF THE INVENTION

This invention relates generally to novelty decorative devices. More particularly, the present invention relates to a reversible decorative device that can switch between multiple positions depending on the desire of the user.

Throughout history, people have been adding decorative material to their clothes and possessions to enhance their visual appeal or to signify the owner's wealth or status. With regard to fabrics and cloths, handicraft is often used to incorporate materials onto a backing in a specific arrangement to form a desired "picture" or pattern. Such well-known methods of handicraft include quilting, needlepoint and cross-stitching among others which attach a substance, such as colored yarn, to the fabric background or backing. As an alternative to sewing additional yarn or fabric on the backing, the use of sequins has arisen in recent years. The sequins, made in a wide variety of colors, are attached to the backing where each sequin forms a certain subsection of the overall image or message. For example, common designs might include household pets or photographs of famous landmarks.

However, if a new design or image is desired on a given decorated article, the previous design must be completely removed from the article and a new design attached. In the alternative, an owner could purchase an identical article and decorate it with the new design. These traditional approaches to decorative articles do not allow switching between multiple designs without prohibitive costs and labor. The present invention overcomes the limitations of the traditional systems and provides other related advantages. The reversible sequin pattern sheet of the present invention is a device for conveying a multiplicity of decorative messages. With the inventive pattern sheet, multiple decorative messages can be displayed at will without the need for removing the sequins to alternate an image or without the need for multiple sheets for each individual image.

BRIEF SUMMARY OF THE INVENTION

In one embodiment, a reversible sequin pattern sheet comprises a layer of fabric positionable substantially in a plane, and a plurality of sequins each having a first surface and a second surface opposite the first surface. The sequins are arranged in an array, each sequin including an aperture extending therethrough between the first and second surfaces, at least a portion of the first and second surfaces of the sequins having different indicia thereon. A thread extends through each aperture and is secured to the fabric layer for securing the sequins to the fabric layer and for allowing each sequin to pivot around the thread with respect to the fabric layer between a first position with the first surface facing the fabric layer and a second position with the second surface facing the fabric layer. The indicia is selected such that when the first surface of at least a portion of the sequins face the fabric layer the corresponding second surfaces face away from the fabric layer and in combination convey a first message and when the second surface of at least a portion of the sequins face the fabric layer the corresponding first surfaces face away from the fabric layer and in combination convey a second message.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
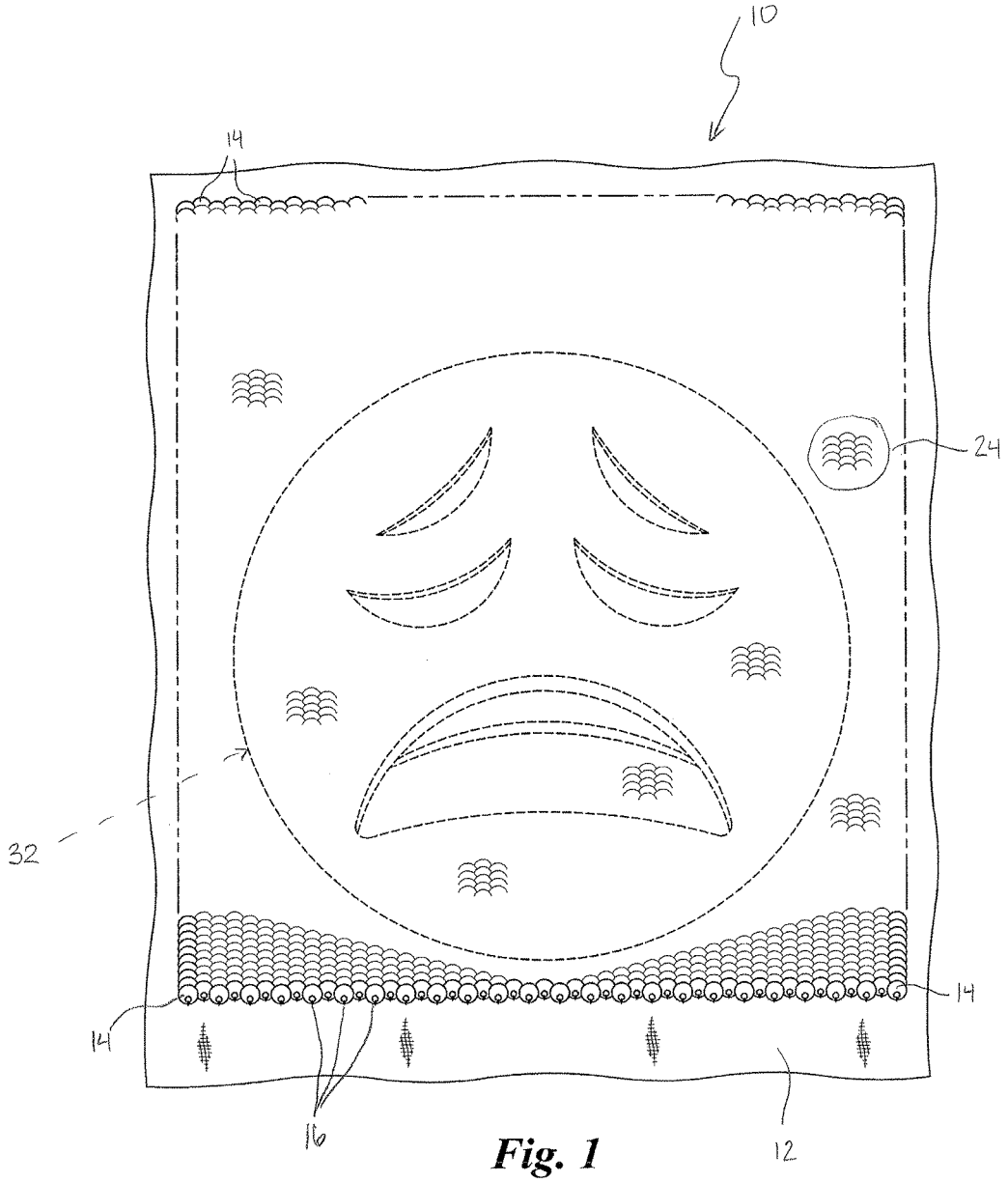
FIG. 1 is a top plan view of a reversible sequin pattern sheet at a first position in accordance with the present invention, with indicia of second surfaces of the sequins shown to convey a first message.

Certain terminology is used in the following description for convenience only and is not limiting. Words designating direction such as "bottom," "top," "front," "back," "left," "right," "sides," "up," and "down" designate directions in the drawings to which reference is made, but are not limiting with respect to the orientation in which the invention and its components and apparatus may be used. The terminology includes the words specifically mentioned above, derivatives thereof and words of similar import.

As used herein, the singular forms "a", "an", and "the" include plural referents, and plural forms include the singular referent unless the context clearly dictates otherwise.

As used herein, the term "about" with respect to any numerical value, means that the numerical value has some reasonable leeway and is not critical to the function or operation of the component being described or the system or subsystem with which the component is used, and will include values within plus or minus 10% of the stated value.

As used herein, the term "substantially" with respect to any numerical value or description of any element or parameter means precisely the value of description of the element or parameter but within reasonable industrial manufacturing tolerances that would not adversely affect the function of the element or parameter or apparatus containing it, but such that variations due to such reasonable industrial manufacturing tolerances are less than variations described as being "about."

Generally speaking, the reversible sequin pattern sheet of the present invention is a device for conveying a multiplicity of decorative images or messages. With the inventive pattern sheet, multiple decorative images or messages can be displayed at will without the need for removing the sequins to alternate an image and without the need for multiple sheets for each individual image.

In an exemplary embodiment, illustrated in FIGS. 1-8, the reversible sequin pattern sheet 10 comprises a layer of fabric 12, a plurality of sequins 14 secured to the fabric 12, and a plurality of threads 16 engaging the sequins 14 and being fixedly secured to the fabric 12 to secure the sequins 14 to the fabric 12. The fabric 12 is configured such that it is substantially positionable within a plane. The fabric 12 can be manufactured from a variety of materials including, but not limited to, cotton, polyester, nylon, wool, wood, or durable polymers or blends or combinations thereof. In a preferred embodiment, the fabric 12 is a flexible material. The shape of the fabric 12 can be any polygonal shape such as a triangle, circle or the like, but referring to FIGS. 1-3, the fabric is preferably a square.

The plurality of sequins 14 each comprises a first surface 18 and a second surface 20 disposed opposite of the first surface 18. The first surface 18 and second surface 20 may be any polygonal shape including, but not limited to, circles, squares, hexagons or the like. In a preferred embodiment, the first and second surfaces 18, 20 are circular. In addition, the shape of the second surface 20 preferably is the same as the shape of the first surface 18, but could be different. Further, the sequins 14 each comprise an aperture 22 extending therethrough between the first surface 18 and the second surface 20. The apertures 22 can be located anywhere within the sequins 14, but are preferably located at least slightly off-center to facilitate better pivotal movement of the sequins 14 relative to the fabric 12, as will be discussed in more detail below.

Figure 2:
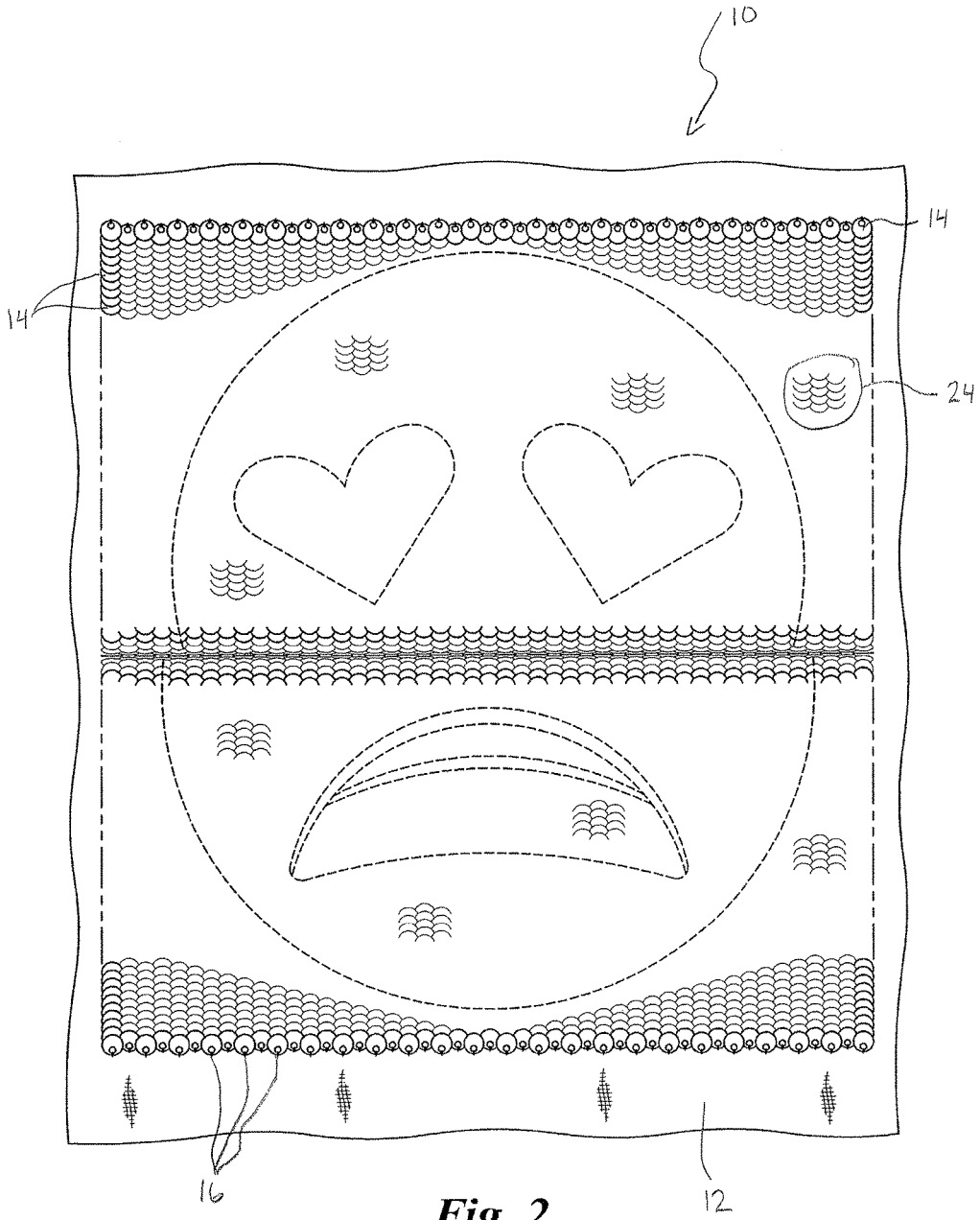
FIG. 2 is a top plan view of the reversible sequin pattern sheet of FIG. 1, transitioning between the first position and a second position.
Figure 3:
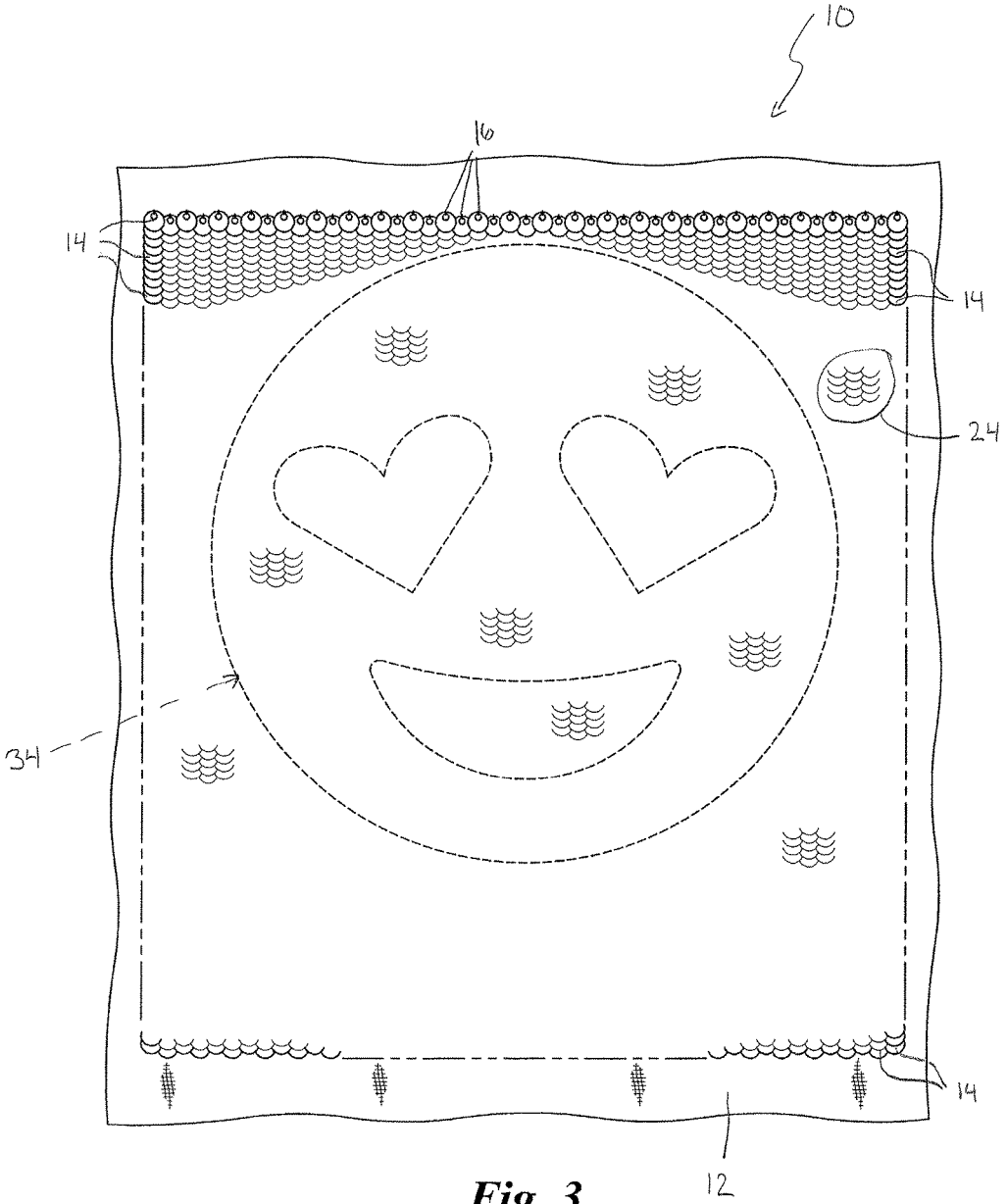
FIG. 3 is a top plan view of the reversible sequin pattern sheet of FIG. 1, in the second position, with the indicia of the first surfaces shown to convey a second message.
Figure 4A:
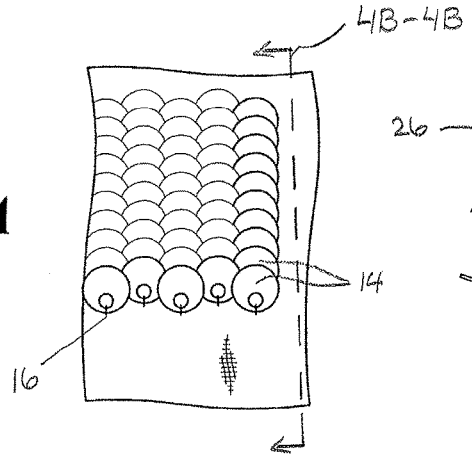
FIG. 4A is an enlarged perspective view of a portion of the reversible sequin pattern of FIG. 1.
Figure 4B:
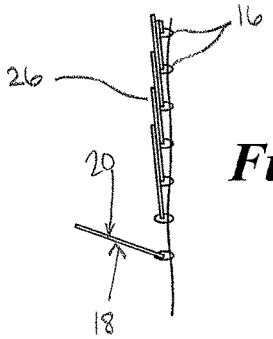
FIG. 4B is a section view at a first position of the reversible sequin pattern sheet taken along line 4B-4B of FIG. 4A.

Referring now to FIGS. 1-3, the sequins 14 are arranged in an array 24 comprising rows and columns. The columns are generally oriented from the top end of the fabric 12 to the bottom end of the fabric 12, while the rows are generally oriented from the left side of the fabric 12 to the right side of the fabric 12 when viewing FIGS. 1-3. Within the array 24, the sequins 14 are spaced such that a significant portion of either the first surface 18 or second surface 20 of each sequin 14 at least slightly overlaps the first or second surface 18, 20 of at least one adjacent sequin 14. The overlap of the sequins 14 can be readily seen from the drawings, for example in FIG. 1.

The array 24 of sequins 14 is configured to have a first position 26 (FIG. 4B) where at least a portion but preferably all of the first surfaces 18 of the sequins 14 are facing and substantially aligned with the fabric 12, and such that the second surfaces 20 of all or at least a corresponding portion of the sequins 14 are facing away from the fabric 12. This can be readily visualized in FIGS. 1 and 4A-B. The array 24 also has a second position 28 (FIG. 6B) in which at least a portion but preferably all of the second surfaces 20 of the sequins 14 are facing and substantially aligned with the fabric 12, and such that the first surfaces 18 of all or at least a corresponding portion of the sequins 14 are facing away from the fabric 12. This is readily visualized in FIGS. 3 and 6A-B. The array 24 is configured such that the individual sequins 14 can be pivoted about the thread 16 from the first position 26 to the second position 28. Due to the overlapping relationship of the sequins 14, the sequins 14 have a "domino effect" when transitioning from the first position 26 to the second position 28 and vice versa. As can be seen in FIG. 2, when between the first and second positions, there is a "wave front" of sequins 14 pivoting between the first and second positions 18, 20.

Figure 5A:
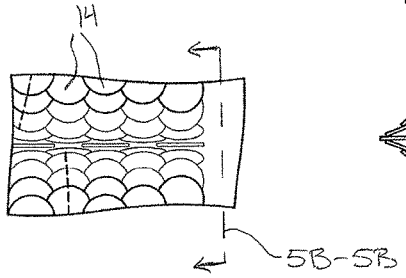
FIG. 5A is an enlarged perspective view of a portion of the transition between the first position and the second position of the reversible sequin pattern sheet of FIG. 2.
Figure 5B:
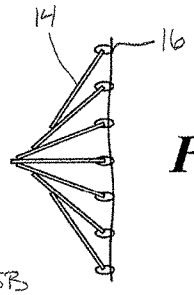
FIG. 5B is a section view taken along line 5B-5B of FIG. 5A.
Figure 6A:
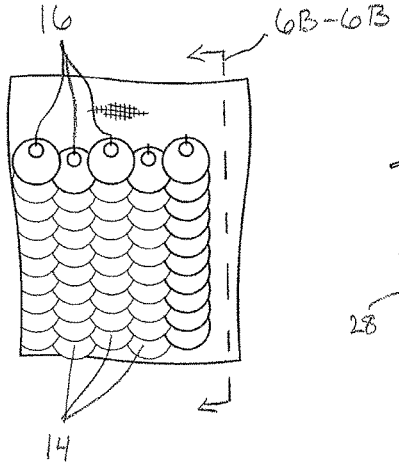
FIG. 6A is an enlarged perspective view of a portion of the reversible sequin pattern of FIG. 3.
Figure 6B:
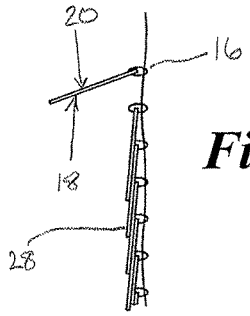
FIG. 6B is a section view taken along line 6B-6B of FIG. 6A.

Referring now to FIGS. 5A-B, a section view of the "wave front" is shown. During the transition, certain sequins 14 are standing generally vertically relative to the fabric 12, while other sequins 14 have either their first surface 18 or second surface 20 partially or substantially facing the fabric 12.

Referring again to FIGS. 1-3, the sequins 14 further comprise different indicia 30 on at least a portion of the first surfaces 18 and/or second surfaces 20. When the array 24 is in the first position 26 (FIG. 1), the indicia 30 of the second surfaces 20, in combination, convey a first message or image 32. Correspondingly, when the array 24 is in the second position 28 (FIG. 3), the indicia 30 of the first surfaces 18, in combination, convey a second message or image 34. The pivotal movement of the sequins 14 relative to the fabric 12 combining with the first and second messages 32, 34 allows a user to have multiple decorative images in the same pattern sheet 10 without undue hassle or cost.

Figure 7:
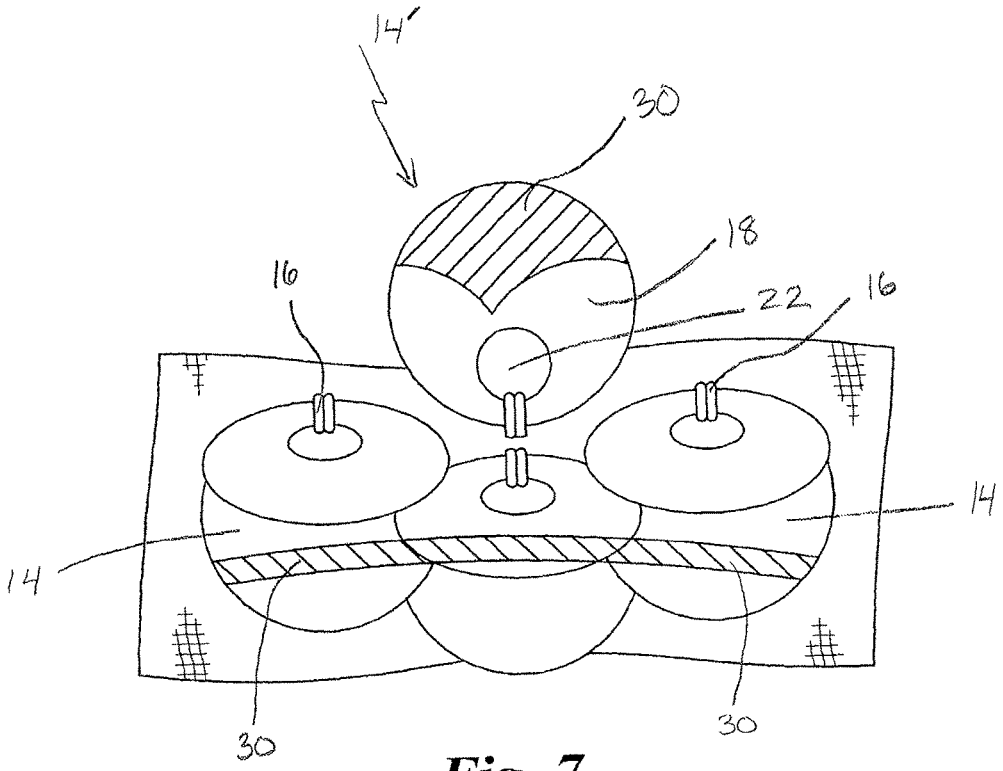
FIG. 7 is an enlarged end view of a portion of the first surface, including a representative indicia thereon, of a sequin of the reversible sequin pattern sheet of FIG. 1.
Figure 8:
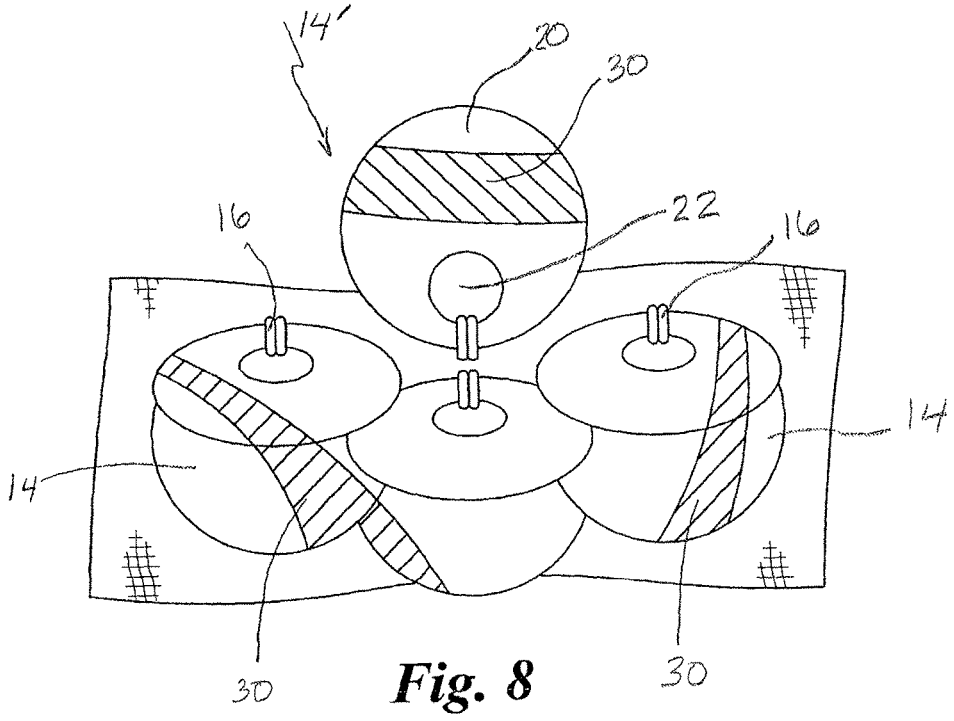
FIG. 8 is an enlarged end view of a portion of the second surface, including a representative indicia thereon, of a sequin of the reversible sequin pattern sheet of FIG. 1.

Referring now to FIG. 7, an exemplary sequin 14' is shown between the first and second positions 26, 28, with its first surface 18 and a respective indicia 30 showing. The remaining sequins 14 are in the first position 26 with their second surfaces 20 and corresponding indicia 30 shown. Conversely, in FIG. 8, the exemplary sequin 14' is shown between the first and second positions 26, 28, with the second surface 20 and its respective indicia 30 showing. In this view, which is a reverse view of FIG. 7, the remaining sequins 14 shown are in the second position 28 with their first surfaces 18 and corresponding indicia 30 viewable.

Referring again to FIGS. 7-8, the reversible sequin pattern sheet 10 further comprises a plurality of threads 16. The threads 16 pass through the apertures 22 of the sequins 14 and fixedly attach at both ends to the fabric 12. The threads 16 are configured as to allow the pivotal movement of the sequins 14 relative to the fabric 12. It will be understood by those skilled in the art that the threads 16 could be manufactured from any suitable material, such as cotton, polyester, nylon, rayon, polyester or wool or blends or combinations thereof among others. In a preferred embodiment, the threads 16 are preferably manufactured from the same flexible material as the fabric 12.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A reversible sequin pattern sheet comprising:

a layer of fabric positionable substantially in a plane;

a plurality of sequins each having a first surface and a second surface opposite the first surface, wherein the sequins are arranged in an array, each sequin including an aperture extending between the first and second surfaces, at least a portion of the first and second surfaces of the sequins having different indicia thereon; and a thread extending through each aperture and being secured to the fabric layer for securing the sequins to the fabric layer and for allowing each of the sequins to pivot around the thread with respect to the fabric layer between a first position with the first surface facing the fabric layer and a second position with the second surface facing the fabric layer, the indicia being selected such that when the first surface of at least a portion of the sequins face the fabric layer the corresponding second surfaces face away from the fabric layer and in combination convey a first message or decorative image and when the second surface of at least a portion of the sequins face the fabric layer the corresponding first surfaces face away from the fabric layer and in combination convey a second message or decorative image.

2. The pattern sheet of claim 1, wherein the array is in the form of a plurality of rows and columns.

3. The pattern sheet of claim 1, wherein the fabric is flexible.

* * * * *